US006685815B2

(12) United States Patent
Kovarsky

(10) Patent No.: US 6,685,815 B2
(45) Date of Patent: Feb. 3, 2004

(54) ELECTROPLATING OF SEMICONDUCTOR WAFERS

(75) Inventor: Nicolay Kovarsky, Sunnyvale, CA (US)

(73) Assignee: Applied Materials Inc., Santa Clara, CA (US)

( * ) Notice: Subject to any disclaimer, the term of this patent is extended or adjusted under 35 U.S.C. 154(b) by 0 days.

(21) Appl. No.: 10/047,537

(22) Filed: Jan. 14, 2002

(65) Prior Publication Data

US 2003/0132118 A1 Jul. 17, 2003

(51) Int. Cl.[7] ..... C25D 21/06; C25D 21/16

(52) U.S. Cl. ..... 205/98; 205/101; 205/118; 205/133; 205/148; 205/157

(58) Field of Search ..... 205/101, 98, 118, 205/133, 148, 157

(56) References Cited

U.S. PATENT DOCUMENTS

| | | | | |
|---|---|---|---|---|
| 4,609,575 A | | 9/1986 | Burkman | |
| 5,087,323 A | | 2/1992 | Park | |
| 5,735,962 A | | 4/1998 | Hillman | |
| 5,830,805 A | | 11/1998 | Shacham-Diamond et al. | |
| 5,953,828 A | | 9/1999 | Hillman | |
| 6,024,856 A | | 2/2000 | Haydu et al. | |
| 6,106,680 A | | 8/2000 | Nogami et al. | |
| 6,207,068 B1 | | 3/2001 | Glick et al. | |
| 6,352,623 B1 | * | 3/2002 | Volodarsky et al. | 204/275.1 |
| 6,482,298 B1 | * | 11/2002 | Bhatnagar | 204/194 |

OTHER PUBLICATIONS

Maeda, et al. "Treating Wastes Generated by Copper Electroplating Tools", Technical Papers & Articles Home, http://www.novellus.com/damascus/tec/tec_17.html, pp. 1–12, Apr. 14, 2000.

* cited by examiner

*Primary Examiner*—Wesley A. Nicolas
(74) *Attorney, Agent, or Firm*—Moser, Patterson & Sheridan

(57) ABSTRACT

An electro-chemical deposition apparatus and method are generally provided. In one embodiment of the invention, an electro-chemical deposition apparatus includes a housing having a substrate support disposed therein and adapted to rotate a substrate. One or more electrical contact elements are disposed on the substrate support. A drive system is disposed proximate the housing. The drive system is magnetically coupled to and adapted to rotate the substrate support. In another embodiment, a method of plating a substrate includes the steps of covering a substrate supported within a housing with electrolyte, and displacing a portion of the electrolyte from the housing prior to electrically biasing the substrate, and electrically biasing the substrate.

18 Claims, 11 Drawing Sheets

ELECTROPLATING OF SEMICONDUCTOR WAFERS

BACKGROUND OF THE INVENTION

1. Field of the Invention

Embodiments of the invention generally relate to a method and apparatus for electro-chemical deposition of a conductive material on a substrate.

2. Background of the Related Art

Sub-quarter micron, multi-level metallization is one of the key technologies for the next generation of ultra large scale integration (ULSI). The multilevel interconnects that lie at the heart of this technology require planarization of interconnect features formed in high aspect ratio apertures, including vias, contacts, lines, plugs and other features. Reliable formation of these interconnect features is very important to the success of ULSI and to the continued effort to increase circuit density and quality on individual substrates and die.

As circuit densities increase, the widths of vias, contacts, lines, plugs and other features, as well as the dielectric materials between them, decrease to less than 250 nanometers, whereas the thickness of the dielectric layers remains substantially constant, with the result that the aspect ratios for the features, i.e., their height divided by width, increases. Due to copper's good electrical performance at such small feature sizes, copper has become a preferred metal for filling sub-quarter micron, high aspect ratio interconnect features on substrates. However, many traditional deposition processes, such as physical vapor deposition (PVD) and chemical vapor deposition (CVD), have difficulty filling structures with copper material where the aspect ratio exceeds 4:1, and particularly where it exceeds 10:1. As a result of these process limitations, electro-plating, which had previously been limited to the fabrication of lines on circuit boards, is now being used to fill vias and contacts on semiconductor devices.

Metal electro-plating is generally known and can be achieved by a variety of techniques. A typical method generally comprises deposition of a barrier layer over the feature surfaces, followed by deposition of a conductive metal seed layer, preferably copper, over the barrier layer, and then electro-plating a conductive metal over the seed layer to fill the structure/feature. After electro-plating, the deposited layers and the dielectric layers are planarized, such as by chemical mechanical polishing, to define a conductive interconnect feature.

While present day electro-plating cells achieve acceptable results on larger scale substrates, a number of obstacles impair efficient and reliable electro-plating onto substrates having micron-sized, high aspect ratio features. For example, ensuring the availability of deposition material within electrolytes utilized during the plating process often requires the amount of deposition material in the electrolyte to be highly monitored. The cost of monitoring systems disadvantageously contributes to a high cost of system ownership. Moreover, if virgin electrolyte (i.e., fresh or unused) is utilized to minimize contact of contaminants present in recycled electrolyte with the substrate, the volume of costly virgin electrolyte utilized to fill the process cell is great. Thus, a significant quantity of electrolyte is exposed to process related contamination without being utilized during plating operations. This inefficient use of electrolyte unnecessarily drives up processing costs.

Therefore, there is a need for an improved electro-chemical deposition system.

SUMMARY OF THE INVENTION

In one aspect of the invention, an apparatus for electro-chemical deposition is generally provided. In one embodiment, a electro-chemical deposition apparatus includes a housing having a substrate support disposed therein and adapted to rotate a substrate. One or more electrical contact elements are disposed on the substrate support. A drive system is disposed proximate the housing. The drive system is magnetically coupled to and adapted to rotate the substrate support.

In another aspect of the invention, a system for electro-chemical deposition is generally provided. In one embodiment, a system for electro-chemical deposition on a substrate includes a first lid, a second lid and a base portion. The first lid has a first lid port and an electrode disposed therein. The second lid has a second lid port. The base portion includes a housing having a substrate support disposed therein. The housing has at least a first port and an upper sealing surface that selectively supports either the first lid or the second lid. A seal is disposed between the upper sealing surface and a lower sealing surface of the first or second lid. The substrate support is adapted to rotate the substrate and includes one or more electrical contact elements.

In another aspect of the invention, a method of plating a substrate is generally provided. In one embodiment, a method of plating a substrate includes the steps of covering a substrate supported within a housing with electrolyte, and displacing a portion of the electrolyte from the housing prior to electrically biasing the substrate, and electrically biasing the substrate.

In another embodiment, a method of plating a substrate includes the steps of supporting a substrate on a substrate support within a housing, covering the supported substrate with electrolyte, magnetically coupling the substrate support with a drive plate disposed exterior to the housing, rotating the drive plate, and electrically biasing the substrate.

BRIEF DESCRIPTION OF THE DRAWINGS

A more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, wherever possible, to designate identical elements that are common to the figures.

DETAILED DESCRIPTION OF THE PREFERRED EMBODIMENT

Figure 1A:
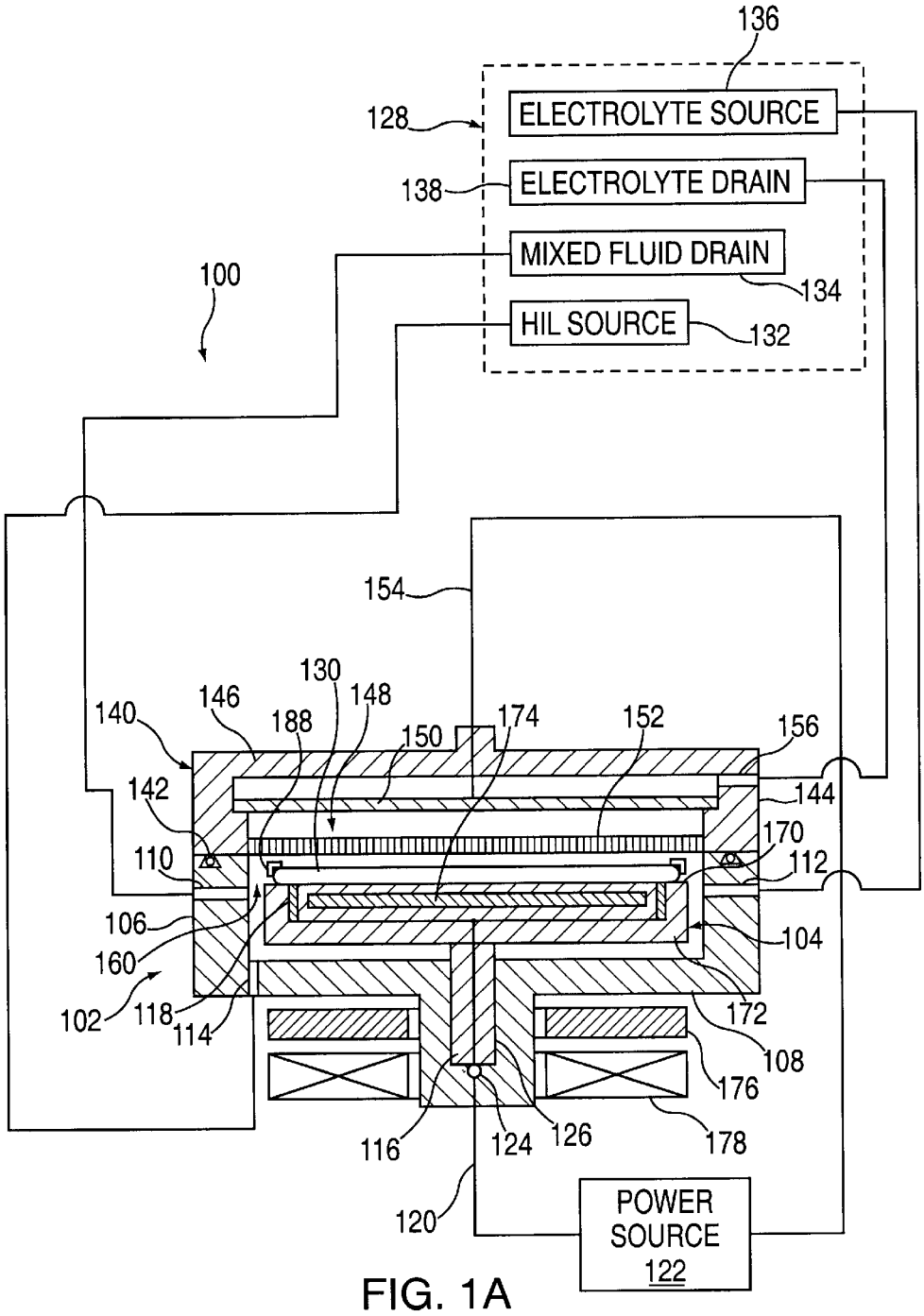
FIG. 1A is a cross-sectional view of one embodiment of an electro-plating process cell according to the invention.

FIG. 1A is a cross-sectional view of an electro-plating process cell 100 according to the invention. The process cell 100 generally comprises a housing 102 having a substrate support 104 disposed therein that supports a substrate 130 during a plating process. A lid 140 is disposed on the housing 102 and encloses a process volume 160 therebetween. A seal 142 is disposed between the lid 140 and the housing 102 to prevent leakage of fluids from the process volume 160. The seal 142 may be a gasket, o-ring, gel or other material or device that prevents passage of fluids between the lid 140 and housing 102. The seal 142 is typically fabricated from an elastomeric material compatible with process chemistries, such as ethylene propylene and silicone, among others.

In the embodiment depicted in FIG. 1A, the housing 102 is generally fabricated from a material compatible with the plating chemistries, for example a plastic, such as a fluoropolymer. The housing 102 includes a sidewall 106 and a bottom 108. The sidewall 106 is generally cylindrical, although a housing comprising multiple sidewalls may be utilized. The sidewalls 106 generally include a first sidewall port and a second sidewall port. The sidewall ports 112, 110 are typically disposed in the sidewall at an elevation above the bottom 108 slightly below a top surface 170 of the substrate support 104. A bottom port 114 is generally disposed in the bottom 108 of the housing 102.

The substrate support 104 generally includes a body 172 supported by a shaft 116 above the chamber bottom 108. The body 172 is typically fabricated from a dielectric material compatible with plating chemistries. The body generally includes one or more contact pins 118 embedded therein. The contact pins 118 generally make electrical contact with the substrate 130 supported on the top surface 170 of the body 172. The contact pins typically are comprised of copper, platinum, tantalum, titanium, gold, silver, stainless steel or other conducting materials. Alternatively, the contact pins 118 may be comprised of a base material coated with a conductive material. For example, the contact pins 118 may be made of a copper base and be coated with platinum. Alternatively, coatings such as iridium and rhodium allows, gold, copper or silver on a conductive base material, such as stainless steel, molybdenum, copper and titanium may be used. Optionally, the contact pins 118 may be made from a material resistant to oxidation, such as platinum, gold, silver or other noble metal. The contact pins 118 are coupled to the power source 122 by a lead 120 that is disposed through the substrate support 104 and housing 102. A slip ring 124 is typically disposed at the interface of the shaft 116 and chamber bottom 108 to allow electrical connections to be maintained between the pins 118 and the power source 122 as the substrate support 104 rotates relative to the housing 102. Alternatively, the contact pins 118 may be positioned to contact the top or edge of the substrate, for example, the contract pins 118 may be part of a clamp ring 188 utilized to secure the substrate to the substrate support 104 during processing.

To facilitate rotation of the substrate support 104 relative to the housing 102, a motor 178 is disposed adjacent the chamber bottom 108. In one embodiment, the motor 178 rotates a drive plate 176 disposed between the motor 178 and chamber bottom 108. The drive plate 176 is magnetically coupled to a plate 174 disposed within the process volume 160. The plate 174 is generally embedded in or attached to the body 172 and/or shaft 116. The magnetic coupling (i.e., attraction) between the drive plate 176 and plate 174 causes the substrate support 104 to rotate as the motor 178 turns the drive plate 176.

In the embodiment depicted in FIG. 1A, the drive plate 176 is fabricated from a permanent magnet while the plate 174 embedded in the body 172 is comprised of a magnetic material. To facilitate rotation of the substrate support 104, a bearing 126 is disposed in the chamber bottom 108 that interfaces with at least a portion of the shaft 116. The bearing 126 and/or the bottom 108 surround the end of the shaft 116 to prevent leakage of fluids from the housing 102. Alternatively, the shaft 126 may sealingly extend through the housing 102 and interface directly or indirectly with the motor 178.

The substrate 130 may be retained to the substrate support 104 by vacuum, electrostatic attraction or mechanical clamping, among other substrate retaining methods. In the embodiment depicted in FIG. 1A, the substrate 130 is secured to the top surface 170 of the substrate support 104 by the clamp ring 188.

Figure 1B:
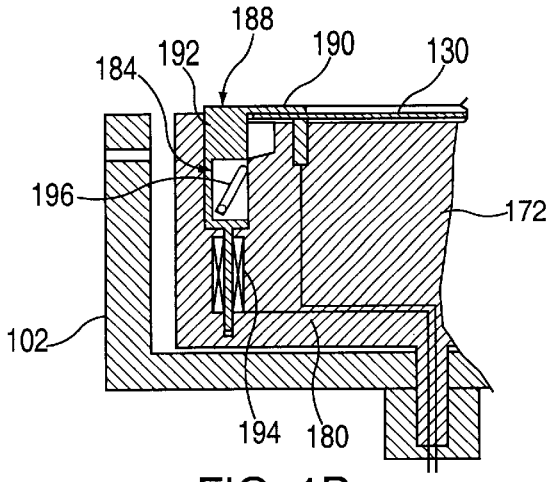
FIGS. 1B–D are a partial sectional views of one embodiment of a substrate support.
Figure 1C:
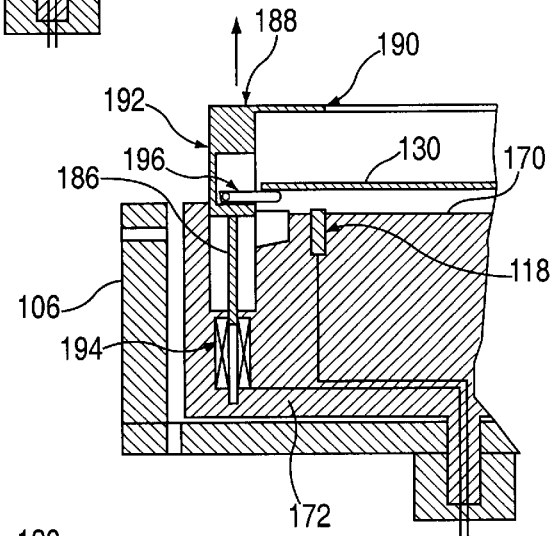
Figure 1D:
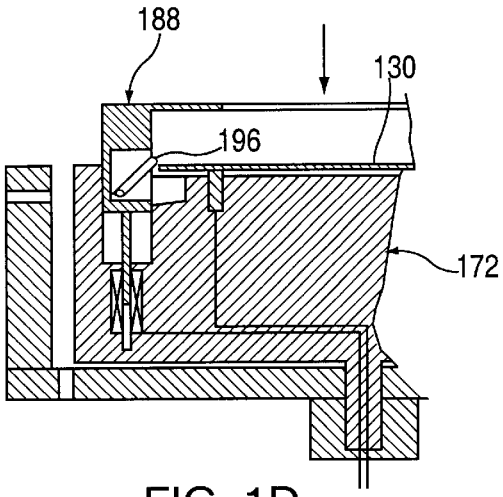

As depicted in FIGS. 1B–D, the clamp ring 188 is movable relative to the substrate support 104. The clamp ring 188 includes cylindrical body 192 having a clamping flange 190 extending radially inwards. The cylindrical body 192 is connected by a shaft 186 to a solenoid 194 which may be energized to move the clamp ring 188 towards or away from the body 174.

The cylindrical body 192 generally includes a plurality of recesses 184 formed on the interior wall of the cylindrical body 192. A pin 196 is typically disposed in each recess 184. In one embodiment, the pin 196 rotates inward was the clamp ring 188 is raised to a position that supports and lifts the substrate 130 above the substrate support 104 to facilitate substrate transfer. The pins 194 generally elevate the substrate 130 such that a robot (not shown) may interface with the substrate (i.e., retain the substrate for transfer) through an aperture (not shown) formed in the cylindrical body 192 while clearing an edge 198 of the housing 102 and the clamp ring. As the clamp ring 188 is lowered, the pin 196 rotates into the recess 184. Alternatively, the pin 196 may be fixed, extending inward from the cylindrical body 192 which may or may not include a recess 184 to accommodate the pin 196.

Power, provided to the solenoid 194 through leads 180 extending through the substrate support 104 and out the housing 102, creates an electro-magnetic force that urges the clamp ring 188 into a spaced-apart relation relative to the top surface 170 of the substrate support 104. Reversing the polarity of the power applied to the solenoid 194 urges the clamp ring 188 towards the substrate support 104, thus clamping the substrate 130 between the flange 190 of the clamp ring 188 and the top surface 170 of the substrate support 104.

Returning to FIG. 1A, the lid 140 is generally fabricated from a material similar to the housing 102. The lid 140 includes a top 146 and walls 144. The seal 142 is disposed between the walls 144 of the lid 140 and the sidewalls 106 of the housing 102 providing a seal therebetween. The walls 144 and top 146 of the lid 140 generally define a lid volume 148. The wall 144 and/or top 146 generally include a lid port 156 formed therethrough and fluidly coupled to the lid volume 148. In the embodiment depicted in FIG. 1A, the lid port 156 is formed through the top 146 of the lid 140.

A membrane 152 is coupled to the walls 144 and generally bounds the lid volume 148. The membrane 152 generally comprises a plurality of pores of a sufficient size and organization to allow uniform flow of electrolyte therethrough while preventing flow of deposition by-products. Typically, the membrane 152 is fabricated from a polymer.

The electrolyte used in processing the substrate typically includes a metal that can be electro-chemically deposited on the substrate. Examples of such metals include copper, tin, tungsten alloys, gold and cobalt among others. As one example, copper sulfate may be used as an electrolyte. Plating solutions containing copper are available from Shipley Ronel, a division of Rohm and Haas, headquartered in Philadelphia, Pa.

A counter-electrode 150 is typically exposed in the lid volume 148 between the membrane 152 and the lid port 156. Generally, the counter-electrode 150 is coupled by a lead 154 that passes through the top 146 of the lid 140 and is coupled to the power source 122. The counter-electrode 150 is generally comprised of the material to be deposited on the substrate, such as copper, nickel, cobalt, gold, silver, tungsten alloys and other materials that can be electro-chemically deposited on a substrate. Alternatively, the counter-electrode 150 may comprise non-consumable material other than the material to be deposited, such as platinum for a copper deposition. Typically, the type of material selected for the counter-electrode is chosen based on the particular deposition process desired. The electrolyte disposed in the lid 140 and housing 102 provides an electrical path between the counter-electrode 150 and the substrate 130 biased by the contact pins 118.

Typically, a fluid circuit 128 is coupled to the process cell 100 to facilitate the supply and removal of electrolyte and other fluids to the process cell 100. In one embodiment, the fluid circuit 128 comprises an electrolyte source 136, an electrolyte drain 138, a mixed fluid drain 134 and a heavy immiscible liquid source 132. The electrolyte source 136 is generally coupled to the second sidewall port 112 in the housing 102. Electrolyte fluid from the electrolyte fluid source 136 generally fills the process volume 136, thereby covering the substrate 130. As additional electrolyte fluid is supplied through the second sidewall port 112, the level of electrolyte in the process cell 100 rises through the membrane 152 and past the counter-electrode 150, exiting the process cell 100 through the lid port 156 to the electrolyte drain 138. The electrolyte drain 138 may be configured to recycle, filter or otherwise hold the electrolyte after it has been used in the plating process.

In order to minimize the amount of electrolyte consumed during the plating process, a heaving immiscible liquid (HIL) is generally flowed into the process volume to a level about equal to or slightly less than the elevation of the top surface 170 of the substrate support 104. The HIL generally may comprise any liquid with the density above 1.2 g/mL, which is insoluble in water solutions (e.g., organic liquids containing chlorine, borene or florine bonds). The HIL may additionally contain detergents that improve the cleaning action of the HIL during electrolyte/water removal from the substrate 140.

Typically, the HIL source 132 is coupled to the bottom port 114. As the HIL enters the process volume 160 through the bottom port 114, the HIL displaces the electrolyte fluid upward within the process volume until the boundary of the HIL and electrolyte reaches a desired elevation within the process volume 160. Typically, this elevation is at or near the top surface 170 of the substrate support 104. As the electrolyte floats on the HIL, the amount of electrolyte utilized within the process cell 100 may be advantageously minimized to only the amount of electrolyte needed to cover the substrate and complete the plating electrical circuit with the counter electrode 150 disposed in the lid 140. Moreover, as the displaced electrolyte has not been contaminated during deposition processing, the displaced electrolyte may be reused without monitoring of the electrolyte's composition.

The mixed fluid drain 134 is typically coupled to the first sidewall port 110. The mixed fluid drain generally receives the HIL flowing from the process volume 160 at a rate that maintains the desired level of HIL within the process volume 160. Some electrolyte fluid may also exit the process cell 100 through the first sidewall port 110 to the mixed fluid drain 134. The fluids received in the mixed fluid drain 134 may be held for disposal or separated for immediate or future recycling.

Once a desired level of electrolyte is achieved within the process cell 100, the motor 178 is activated to rotate the substrate 130 seated on the substrate support 104. The power source 122 applies a bias across the substrate 130 and the counter-electrode 150, thereby causing material from the counter-electrode and/or the electrolyte to deposit on the surface of the substrate 130.

Figure 2:
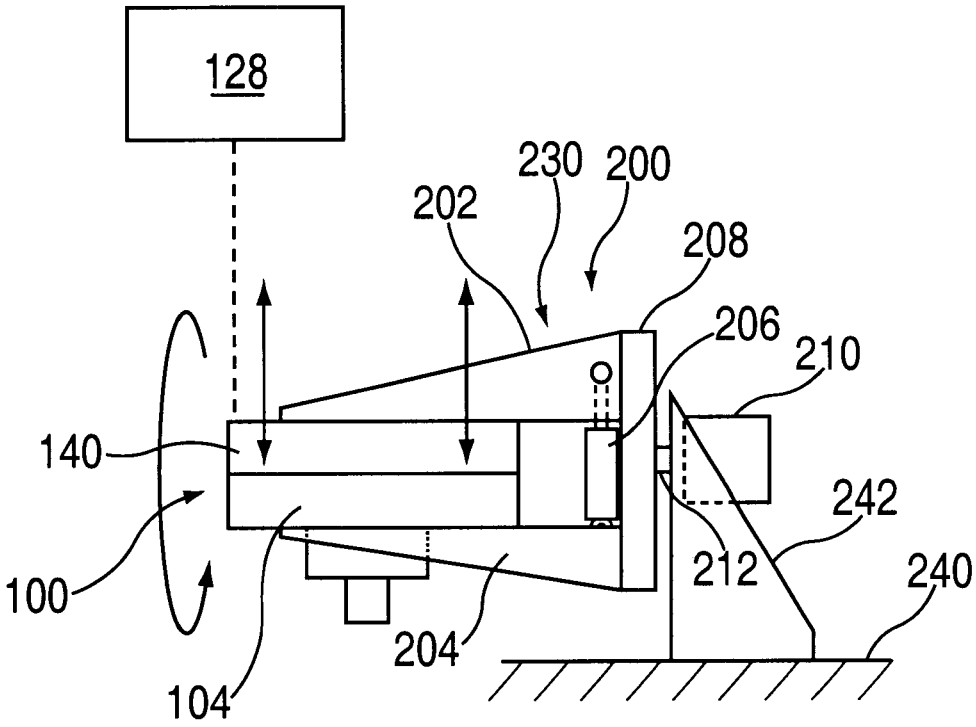
FIG. 2 is an elevation of one embodiment of a processing system including the process cell of FIG. 1A.

FIG. 2 depicts one embodiment of a processing system 200 having a process cell 100. The processing system 200 generally includes a clamp assembly 230 coupled to a base 240 by a bracket 242. The clamp assembly 230 generally moves the lid 140 and housing 102 of the process cell 100 toward and away from each other to facilitate substrate transfer and clamping of the lid 140 and housing 102 during processing.

The clamp assembly 230 generally includes a first member 202 and an opposing second member 204 that are coupled to a guide 208. The first member 202 and second member 204 are movable relative to each other and are respectively coupled to the lid 140 and housing 102 of the process cell 100.

In the embodiment depicted in FIG. 2, the first member 202 is movably coupled to the guide 208. The second member 204 is coupled to the guide 208 in a fixed position. An actuator 206 is coupled to the first member 202 to control the spacing between the first member 202 and the second member 204. Typically, the actuator 206 is also coupled to the second member 204 or guide 208. The actuator 206 may be a pneumatic cylinder, a hydraulic cylinder, a solenoid, a lead or ball screw, a rack and pinion or other device that facilitates linear motion between the first and second members 202, 204.

The clamp assembly 230 is rotatably mounted to the bracket 242. The clamp assembly 230, and process cell 100 held therein, may be selectively rotated between a horizontal orientation as shown in FIG. 2 and a vertical position. A substrate held in the vertically orientated process cell 100 will also have a vertical orientation that advantageously prevents bubble formation on the substrate during processing, thereby promoting plating uniformity.

In the embodiment depicted in FIG. 2, a shaft 212 passes through the bracket 242 and supports the clamp assembly 230. The shaft 212 is coupled to a rotary actuator 210 that controls the angular orientation (i.e., vertical or horizontal) of the flow cell 100. The actuator 210 may be an electric motor, a pneumatic motor, a hydraulic motor, a solenoid, or other device that may control rotation of the shaft 212 and/or clamp assembly 230.

Figure 3:
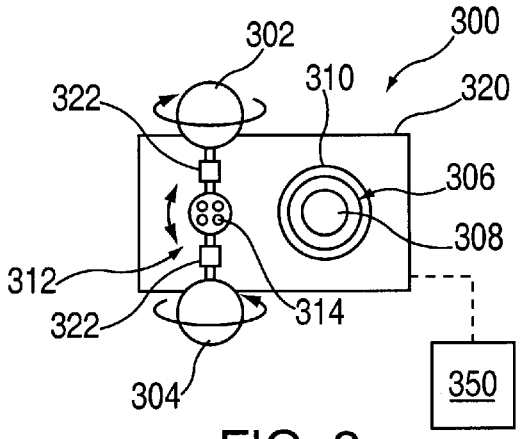
FIG. 3 is a plan view of another embodiment of a processing system.

FIG. 3 depicts a system 300 having a dual lid assembly 312. The dual lid assembly 312 includes a plurality of lids, for example, a first lid 302 and a second lid 304, which are selectively disposed on a housing 306 containing a substrate support 308. The housing 306, first lid 302 and substrate support 308 are generally similar to the housing 102, lid 140 and substrate support 104 described above. A seal 310 selectively seals the first lid 302 or second lid 304 to the housing 306 to prevent fluid leakage therebetween.

The dual lid assembly 312 generally includes a carousel 314 or other robotic device disposed adjacent the housing 306. The carousel 314 and housing 306 are supported on a base 320. The carousel 314 selectively positions one of the lids 302, 304 over the housing 306. The dual lid assembly 312 may include an actuator (not shown) that controls the elevation of the lids 302, 304 relative to the base 320. The actuator sealingly urges the lid 302, 304 against the housing 306 when positioned thereover.

Alternatively, the housing 306 may be adapted to rotate about the carousel 314 and align with the lids 302, 304. The housing 306 may also be adapted to extend from the base 320 to seal against the lids 302, 304.

Optionally, the lids 302, 304 of the dual lid assembly 312 may be selectively coupled to the housing 306 such that the housing 306 is lifted from the base 320 for processing. The dual lid assembly 312 may additionally include a rotary actuator 322 coupled to each lid 302, 304 to control the angular orientation of the lids 302, 304 as described above with reference to the system 200.

A fluid circuit 350 is coupled to the system 300 to provide and remove electrolyte and other fluids. The lids 302, 304 generally are coupled to the fluid circuit 350 via a rotary union (not shown) disposed below the carousel 314. The fluid circuit 350 is also fluidly coupled to the housing 306.

The first lid 302 is generally disposed against the housing 306 during plating processes. The second lid 304 is generally disposed against the housing 306 to facilitate post-plating removal of the electrolyte from the housing 306 and/or rinsing of the substrate. For example, a substrate is seated on the substrate support 308 and the first lid 302 is moved to seal with the housing 306. The housing 306 and first lid 302 are flooded with electrolyte and the substrate is plated with a plating process similar to that described above. The electrolyte is then drained at least to a level that allows the first lid 302 to be removed from the housing 306 and sealing replaced by the second lid 304. In one embodiment, the electrolyte is removed from the housing 306 by flooding the housing 306 and first lid 302 with an HIL that displaces substantially all of the electrolyte therefrom. Typically, the HIL is supplied through a port in the bottom of the housing 306, thereby forcing the lighter electrolyte out of the lid port. Alternatively, the flooding of the housing 306 with the HIL may occur after the second lid 304 is disposed on the housing 306. Once the second lid 304 is disposed on the housing 306, the HIL is rinsed from the housing 306 and substrate. Typically, the rinsing of the housing 306 is performed by flowing water through a port in the second lid 304. The second lid 304 is then lifted off the housing 306 to allow a transfer mechanism (not shown) to remove the substrate from the substrate support.

Figure 4:
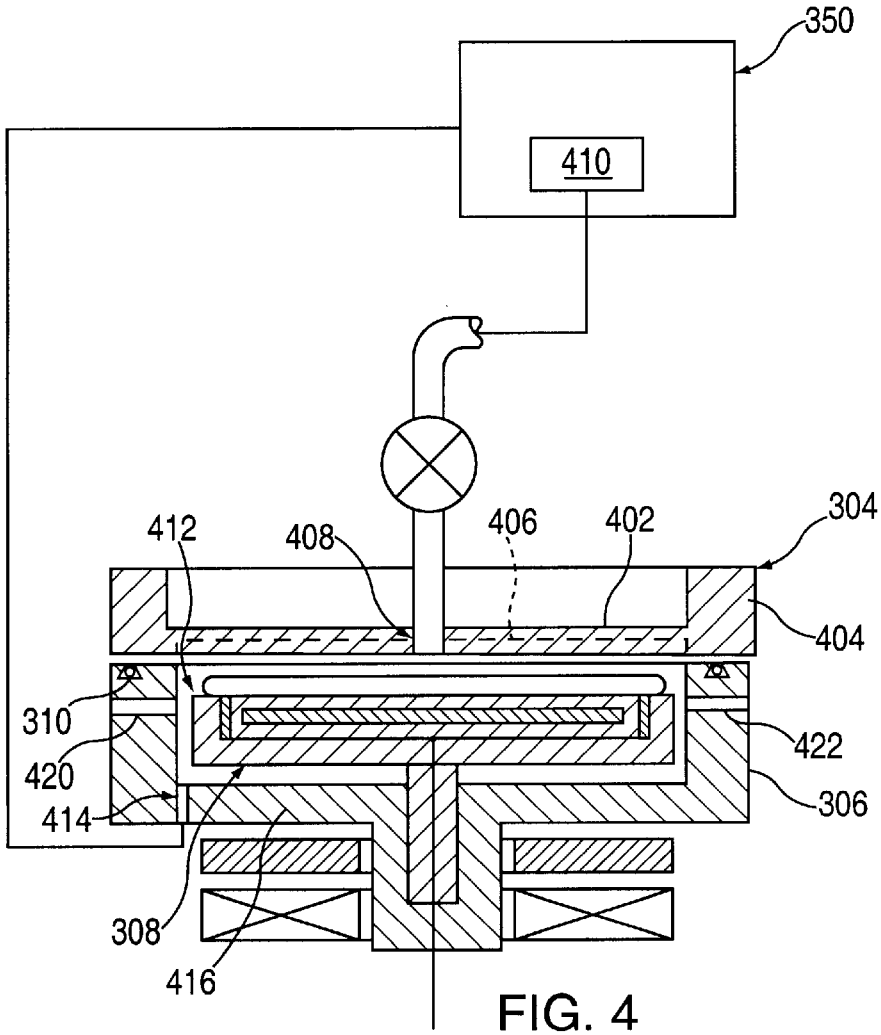
FIG. 4 is a cross-sectional view of another embodiment of electro-plating process cell.

FIG. 4 depicts the second lid 304 and housing 306 in greater detail. The second lid 304 is generally fabricated from a material similar to the lid 140 described above. The second lid 304 includes a bottom 402 and walls 404. The bottom 402 is typically flat and configured to mate with the housing 306. The seal 310 is disposed between the bottom 402 of the second lid 304 and the housing 306 providing a seal therebetween. Optionally, the bottom 402 may include a recess 406 (shown in phantom) formed in the bottom 402 inward of the seal 310. The bottom 402 and walls 404 of the second lid 304 are typically configured to define little or no volume.

A second lid port 408 is generally disposed through the top 402 or walls 404 of the second lid 304. The second lid port 408 is coupled to a water source 410 of fluid circuit 350. The water source 410 controllably supplies water to a volume 412 defined between the second lid 304 and the interior of the housing 306. The lighter water flowing into the top of the volume 412 forces the heavier HIL remaining in the volume 412 out a port 414 disposed in a bottom 416 of the housing 306, thereby sweeping the HIL from the volume 412 substantially without mixing with the water. During the removal of the HIL from the volume 412, flow through a first port 420 and a second port 422 disposed in the housing 306 is typically prevented.

Figure 5:
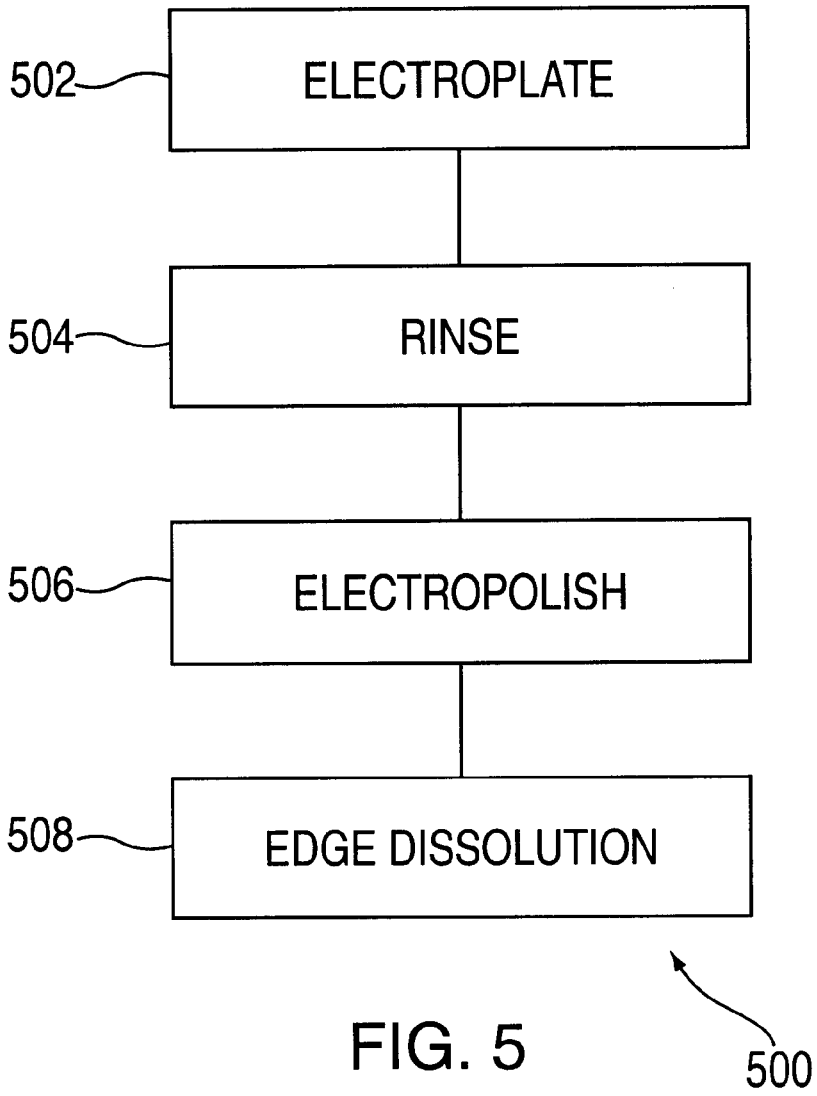
FIG. 5 is a flow diagram of one embodiment of a method of plating a substrate.

FIG. 5 is a flow diagram illustrating one embodiment of an electro-plating process 500 which may be practiced using electro-plating systems similar to those described above, among others. The process 500 generally begins with a depositing or electro-plating a substrate at step 502, followed sequentially by rinsing the electro-plated substrate at step 504 and an edge disillusion process at step 508. Optionally, the disillusion step 508 may be followed by electro-polishing the substrate at step 506.

Figure 6:
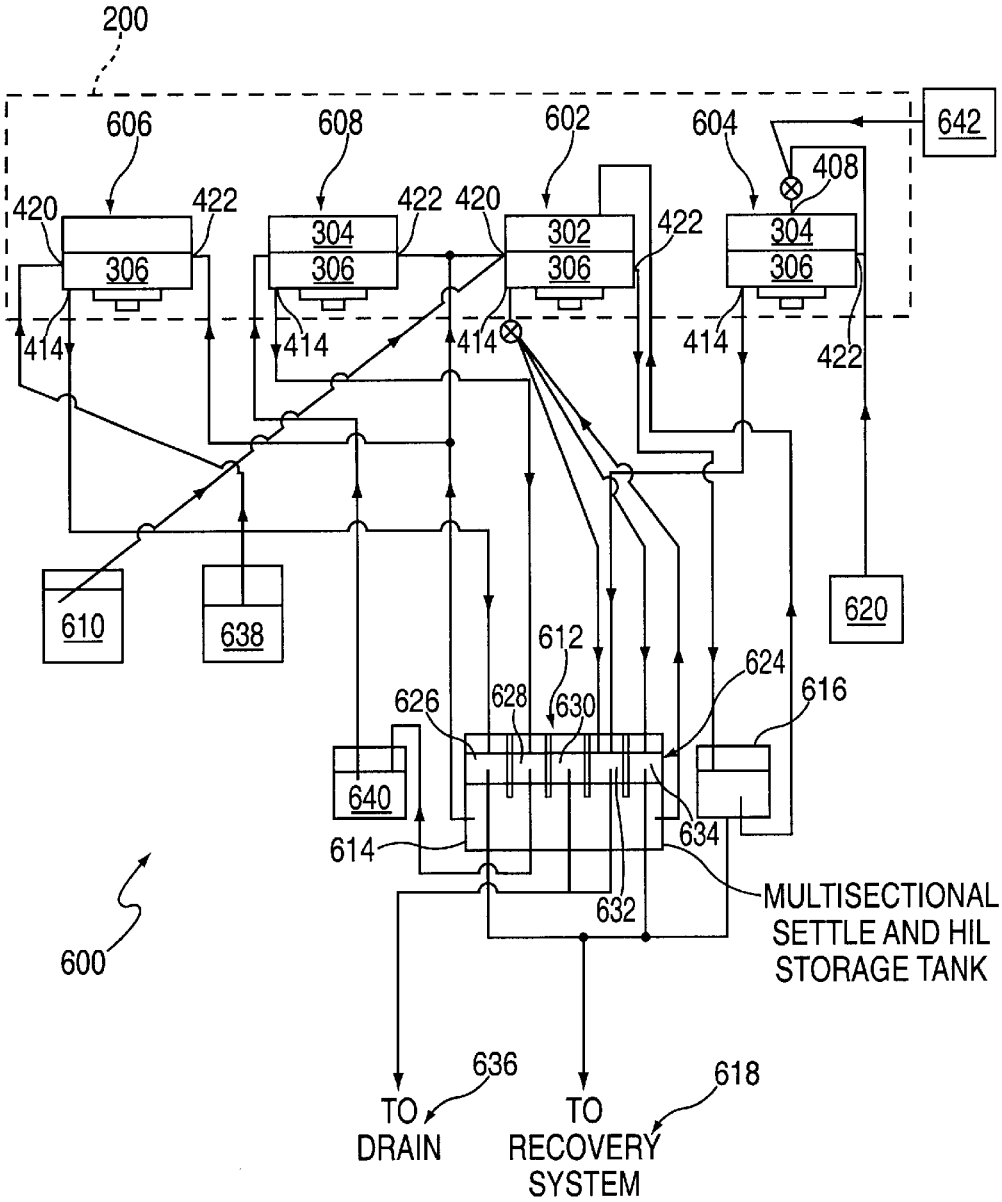
FIG. 6 is a simplified schematic of one embodiment of a flow circuit.

FIG. 6 depicts a flow schematic of one embodiment of a flow circuit 600 which may be utilized with the process 500. The system 300 is illustrated in FIG. 6 in four configurations to better depict which lid is coupled to the housing during different stages of the substrate plating process 500. Although a copper plating process is illustrated, the process 500 and flow circuit 600 is contemplated for plating deposition of materials other than copper. Cell 602 represents the system 300 having the first lid 302 coupled to the housing 306 during the deposition or electro-plating step 502. Cell 604 represents the system 300 having the second lid 304 coupled to the housing 306 during the rinsing step 504. Cell 606 represents the system 300 having the second lid 304 coupled to the housing 306 during the edge disillusion step 508. Cell 608 represents the system 300 having the first lid 302 coupled to the housing 306 during the electro-polish step 506. In one embodiment, the cells 602, 604, 606 and 608 may be formed by retaining the substrate in the housing 308, placing an appropriate lid thereon or by transferring the substrate between cells each comprising a single housing and lid combination.

In step 502, the cell 602 is filled with electrolyte from an electrolyte source 610 through the lid 302. In the embodiment depicted in FIG. 6, the electrolyte source 610 supplies a copper electrolyte such as Ultrafil™, available from Shipley Ronel. HIL is flowed from a lower portion 614 of a settling tank 612 to the bottom port 414 of the housing 306 of cell 602. The HIL displaces a portion of the electrolyte within the cell 602 so that only the amount of electrolyte needed for substrate coverage is retained in the cell 602. The excess electrolyte is returned to the electrolyte source 610, thereby conserving the amount of electrolyte used. Conservation of unused electrolyte is particularly beneficial when the electrolyte source 610 supplies virgin electrolyte to the system 300.

During processing, the substrate is rotated and electrically biased as described above. Working electrolyte is then flowed through the cell 602 from the lid 302 and out the second port 422 in the housing 306. The working electrolyte is typically collected in a working electrolyte tank 616 and recycled through the cell 602. The working electrolyte may additionally be filtered before entering the lid 302 and/or tank 616. As the working electrolyte is separate from the main electrolyte supplied by the electrolyte source 610 at the beginning of the process 500, monitoring of the working electrolyte may be simplified or eliminated.

When electro-plating is completed, HIL is flowed into the cell 602 from the bottom port 414 to displace the electrolyte out the first lid 302 into the working electrolyte tank 616 for use during subsequent plating operations. The working electrolyte tank 616 is also coupled to a recovery system 618. The recovery system 618 is configured to recover copper from the working electrolyte. The first lid 302 is then removed from the housing 306 and replaced by the second lid 304 as illustrated by the second cell 604. One copper recovery system that may be adapted to benefit from the invention is available from Microbar, located in Sunnyvale, Calif.

The second cell 604 is generally configured to remove the HIL and rinse the substrate. Water is provided to the cell 604 from a water source 620. The water added through the lid 302 of the cell 604 displaces the HIL out of the cell 604 through the port 414 in the bottom of the housing 306. The HIL flows from the cell 604 to an upper portion 624 of the settling tank 612 where it sinks and collects in the lower portion 614 of tank 612.

The settling tank 612 generally includes a plurality of baffles 622 disposed in the upper portion 624. The baffles 622 segregate the upper portion 624 into a plurality of compartments, for examples, a first through fifth compartment 626, 628, 630, 632 and 634. Each compartment is in fluid communication with the lower portion 614, thereby allowing any HIL within the compartment to separate from other fluids within the compartment and fall into the lower portion 614 of the settling tank 612 where it is collected and used in various stages of the process 500. In the embodiment depicted in FIG. 6, the HIL removed from the second cell 604 enters the settling tank 612 at the fourth compartment 632. Water collected in the fourth compartment 632 is flowed to a drain system 636 for removal from the fluid circuit 600.

The edge disillusion step 508 is typically performed with the second lid 304 disposed on the housing 306 as depicted by cell 606. In the edge disillusion step 508, a dissolving fluid is flowed into the cell 606 through the first port 420 in the housing 306 from a dissolving fluid supply tank 638. The dissolving fluid generally removes the deposited material at the substate's edge. The dissolving fluid is typically an acid or mixed acid, one embodiment of which is sulfuric acid mixed with peroxide.

To minimize the volume of dissolving fluid utilized in the cell 606, HIL is disposed in the lower portion of the cell 606 so that the dissolving fluid, which floats on the HIL, may be maintained at a level closer to the substrate seated in the support within the cell 606. After plating material is removed from the edge of the substrate, the cell 606 is flooded with HIL to displace the dissolving fluid from the cell 606. The HIL is then drained from the cell 606 after the dissolving fluid has been removed.

Dissolving fluid and/or HIL generally exits the cell 606 through the second port 422 in the housing 306. The exiting fluid is routed into the settling tank 612 through the first compartment 626. The HIL sinks to the lower portion 614 of the settling tank 612. The dissolving fluid in the first compartment 626 is drained to the recovery system 618 for the recovery of the plating material removed from the substrate in cell 606.

If an electro-polishing step 508 is to occur after the edge disillusion step 508, the second lid 304 is replaced with the first lid 302 as depicted in cell 608. The electro-polishing step 508 begins with rinsing the remaining HIL from the cell 608 with an electro-polishing electrolyte from an electro-polishing electrolyte tank 640. Electro-polishing electrolyte and HIL are removed from the cell 608 through the second port 422 and transferred to the second compartment 628 of the settling tank 612. HIL in the second compartment 628 sinks and collects in the second portion 614 of the settling tank 612. Electro-polishing fluid remaining in the second compartment 628 is transferred to the electro-polishing electrolyte tank 640 for reuse. After a few seconds of rinsing, the cell 608 is filled with electro-polishing electrolyte and electrolysis begins.

When electro-polishing ends, a rinsing process begins by first replacing the first lid 302 by the second lid 304 to form the cell 602. The cell 602 is cleaned with HIL then water as described above.

When electro-polishing ends, a rinsing process begins by first replacing the first lid 302 by the second lid 304 to form the cell 602. The cell 602 is cleaned with HIL, then water as described above.

Figure 12:
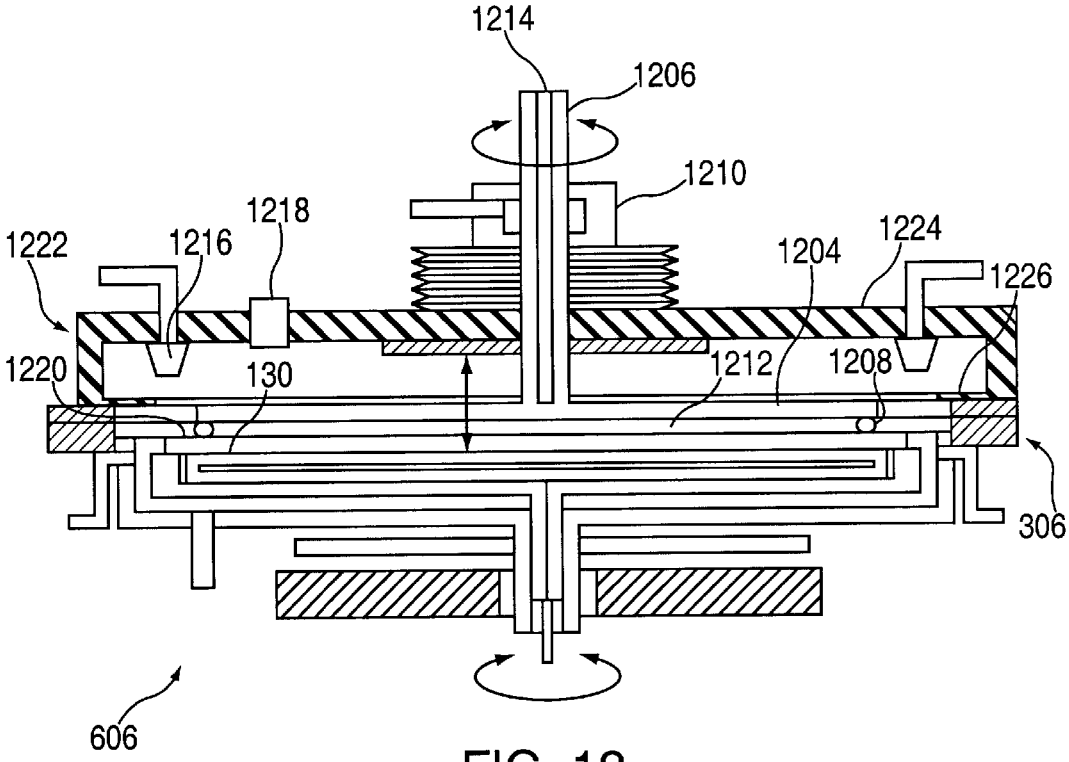
FIG. 12 is a sectional view of another embodiment process cell.

The edge disillusion (or bevel clean) step 506 is typically performed in process cell 606, one embodiment of which is depicted in FIG. 12.

The cell 606 generally includes a housing 306 and a lid assembly 1222. The lid assembly generally includes a housing 1224 and a mounting flange 1226 that facilitates sealing the lid assembly 1222 to the housing 306. A cover plate 1204 is generally disposed in the lid assembly 1222. The cover plate 1204 is coupled by a shaft 1206 that passes through the housing 1224 and is coupled to a rotary actuator (not shown). The shaft is additionally coupled to an actuator 1210 that is utilized to move the cover plate 1204 toward and away from the substrate 130 disposed in the housing 306. The cover plate 1204 generally has a seal 1208 coupled thereto. When the cover plate 1204 is urged toward the substrate 130, the seal 1208 prevents liquids from the seal 1208 isolates the center region of the substrate 130, leaving only an edge 1220 of the substrate 130 exposed during processing.

To increase the sealing force between the seal 1208 and the substrate 130, the region 1212 between the cover plate 1204 and the substrate 130 may be evacuated through a passage 1214 disposed through the shaft 1206. Additionally, as the vacuum applied to the region 1212 vacuum chucks the substrate 130 to the cover plate 1204, the substrate 130 from the housing 306 by actuating the cover plate 1204. With the substrate 130 elevated from the housing 306, dissolving fluid can access the substrate's backside, thereby removing any plating with may have inadvertently formed on the substrate.

Nozzles 1216 are generally disposed in the housing 1224 to provide dissolving liquid water and hot air during various process steps. Additionally, the lid assembly 1222 may include a vent 1218 to allow the hot air to escape during the drying process.

Referring both the FIGS. 6 and 12, in the edge disillusion step 506 a dissolving fluid is flowed into the cell 606 through the nozzles 1216 disposed into the lid assembly 1222 from a dissolving fluid supply tank 638. The dissolving fluid generally removes the deposited material at the substrate's edge 1220 and backside. The dissolving fluid is typically an acid or mixed acid, one embodiment of which is sulfuric acid with peroxide The dissolving fluid utilized exits the cell 606 through the port 414 in the housing 306 and is routed into the settling tank 612 through the first compartment 626. After plating material is removed from the edge 1220 (or edge and backside) of the substrate, the cell 606 is flooded with HIL to displace the dissolving fluid from the cell 606. The HIL is then drained from the cell 606, after the dissolving fluid has been removed.

When edge disillusion step and displacement of the dissolving fluid ends, a water rinsing process begins in the same cell to clean it from HIL. The processed substrate is then dried in the same cell by flowing a gas from a gas source 642 thereof. In one embodiment, the gas may comprise filtered warm air, nitrogen, hydrogen or a mixture thereof.

Then the edge disillusion lid is removed from the housing, the wafer is moved up from the support (by wafer's lifting device disposed into housing and described above) so that robot can take it out from the housing and replace it by the new wafer.

Figure 7:
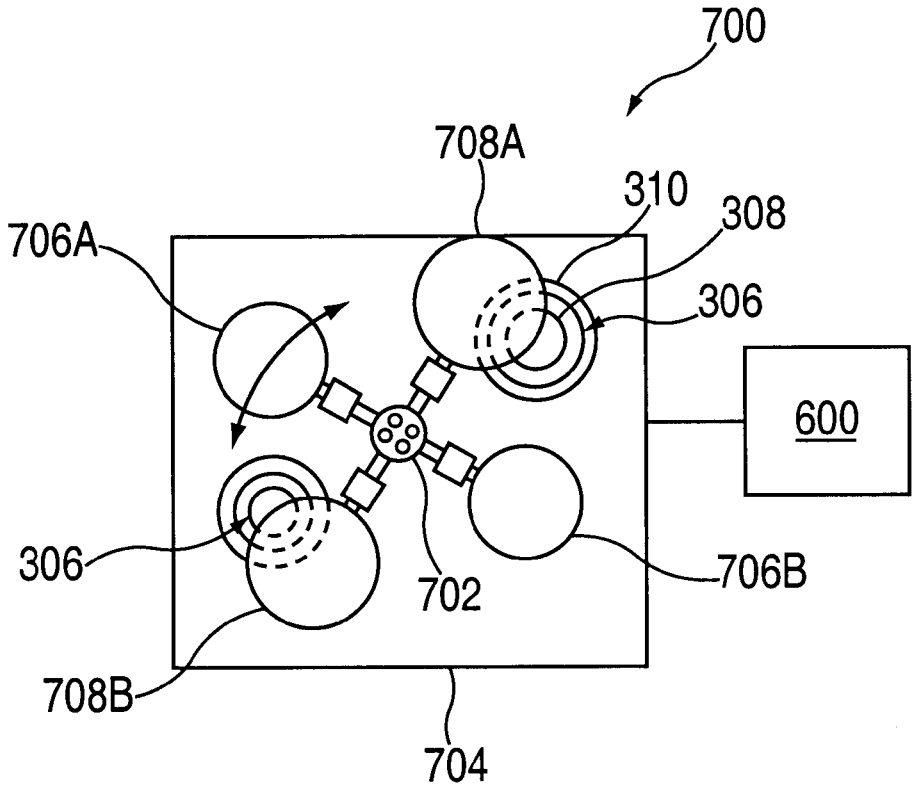
FIG. 7 is a plan view of another embodiment of a processing system.

FIG. 7 depicts another embodiment of a system 700 in which the process 500 may be practiced. The system 700 is generally similar to the system 300 described above except that the system 700 includes a plurality of housings 308 and a plurality of first and second lids shown as first lids 706A, 706B and 708A, 708B, respectively. The first lids 706A–B are generally similar to the first lid 306 while the second lids 708A–B are generally similar to the second lid 308 described above. The lids 706A–B, 708A–B are supported above a base 704 of the system 700 by a carousel 702. The carousel 702 selectively positions an appropriate lid on a housing 306 to form the particular cell 602, 604, 606 and 608 as required by the particular operational step of the method 500 being performed in the respective housing 308.

Figure 8:
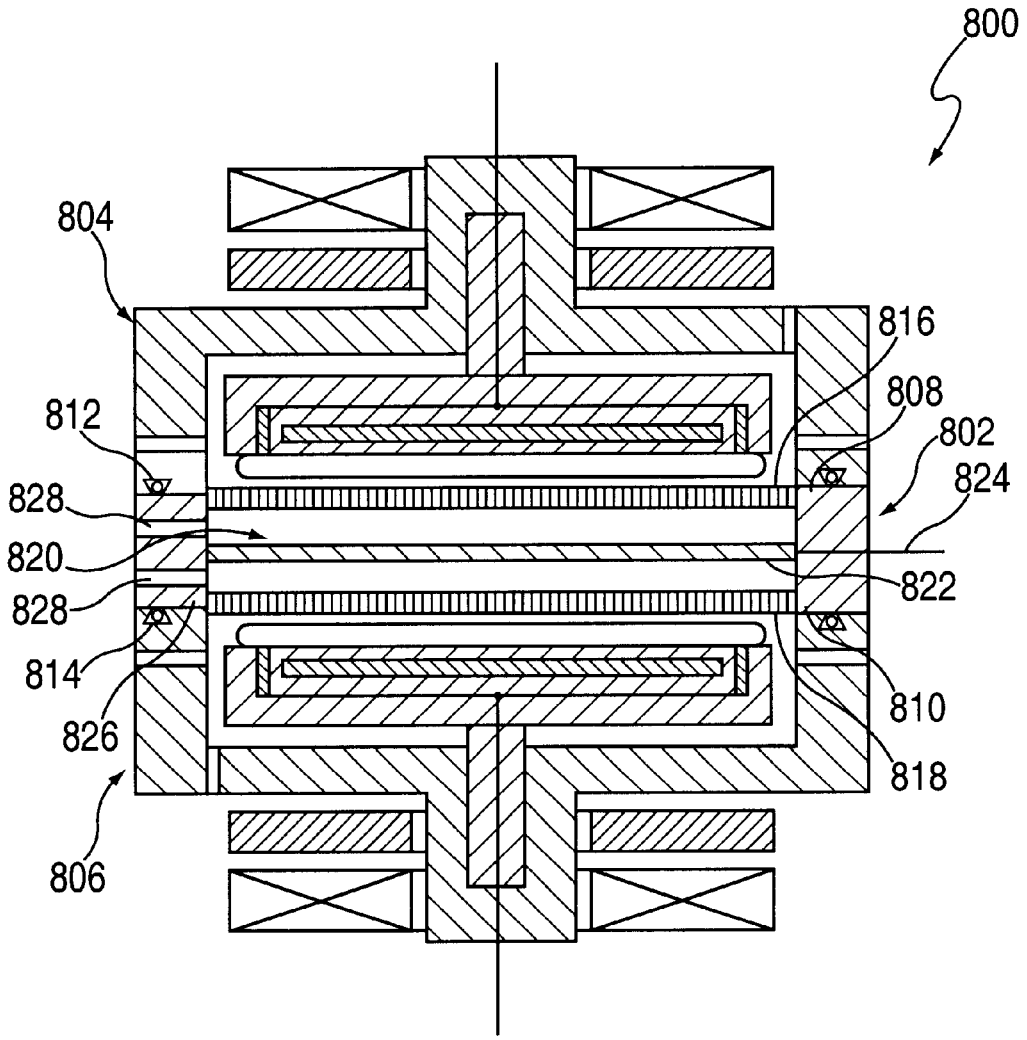
FIG. 8 is a cross-sectional view of another embodiment of a process cell.

Processing systems according to the invention may additionally be configured to have lids that accept multiple housings and housings that accept multiple lids, thereby facilitating simultaneous processing of multiple substrates. For example, FIG. 8 depicts a process cell 800 having a lid 802 that simultaneously accepts a first housing 804 and a second housing 806. The housings 804 and 806 are generally configured similar to the housings 102 and 306 described above.

The lid 802 is generally cylindrical in form and has a first end 808 and an opposing second end 810. A first seal 812 is disposed between the first end 808 of the lid 802 and the first housing 804. A second seal 814 is disposed between the second end 810 of the lid 802 and the second housing 806. A first membrane 816 spans the first end 808 and a second membrane 818 spans the second end 810 of the lid 802 defining a lid volume 820 therebetween.

A counter-electrode 822 is typically exposed in the lid volume 820 between the membranes 816, 818. Generally, the counter-electrode 822 is coupled by a lead 824 that passes through the lid 802 and is coupled to a power source (not shown). The counter-electrode 822 may be permeable to electrolytes and other fluids.

A wall 826 of the lid 802 typically contains one or more ports 828. The ports 828 are generally disposed between the counter-electrode 822 and the membranes 816, 818. In embodiments where the counter-electrode 822 is not permeable, the flow of electrolyte to each housing 804, 806 may be independently controlled through each port 828. The flow of electrolyte to each housing 804, 806 may also be managed by controlling the fluid exiting ports formed within each housing 804, 806.

Figure 9B:
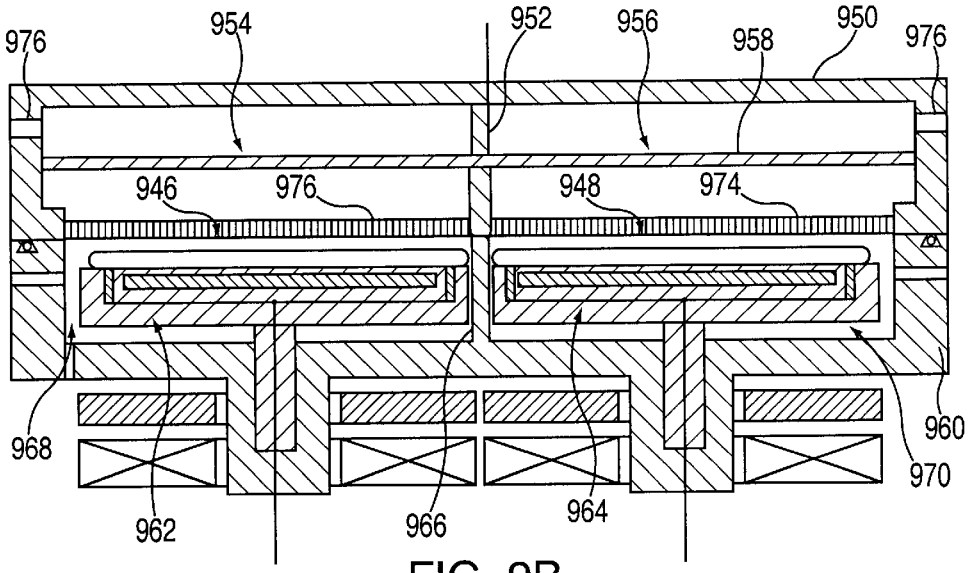
FIGS. 9A–C are cross-sectional views of various embodiments of process cell housings and lids.
Figure 9A:
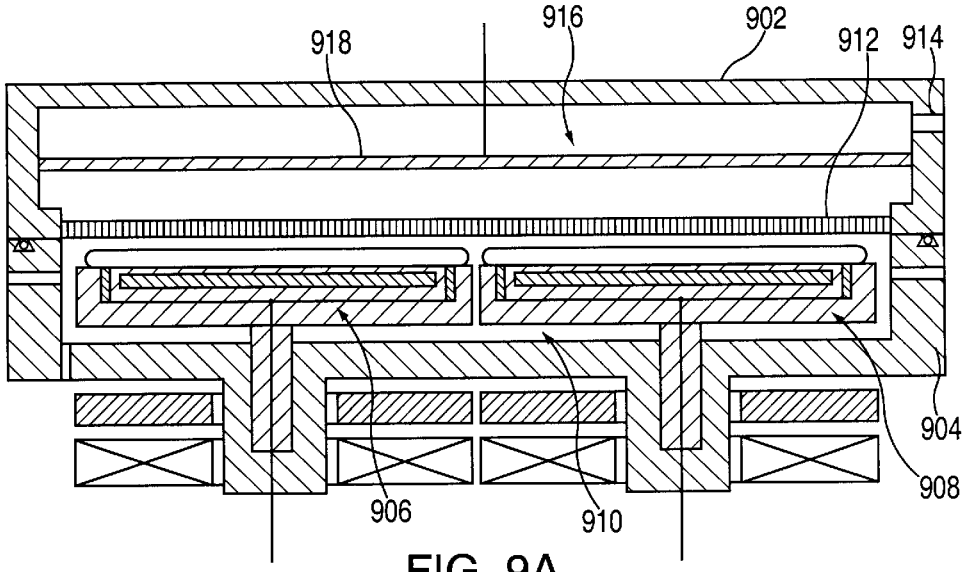
Figure 9C:
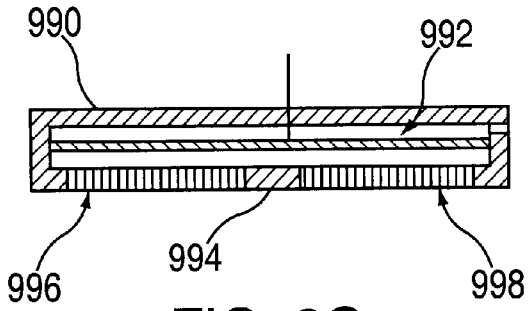

FIGS. 9A–C depicts embodiments of a lid configured to interface with more than a housing having more than one substrate support. In the embodiment depicted in FIG. 9A, a lid 902 sealing covers a housing 904 having a first substrate support 906 and a second substrate support 908. The substrate supports 906, 908 are generally disposed in a common volume 910 defined within the housing 904. A counter-electrode 918 is disposed in the lid 902. The lid 902 has a single membrane 912 that generally confines a single plenum 916 within the lid 902. The single plenum 916 allows a single fluid port 914 formed through the lid 902 to supply fluids to the substrate supports 906, 908 simultaneously from a single fluid source (not shown).

A lid 950 depicted in the embodiment illustrated in FIG. 9B mates with a housing 960 that includes a first and a second substrate support 962, 964. The housing 960 has an internal wall 966 that separates the housing into two independent processing regions 968, 970, each having one of the substrate supports 962, 964 disposed therein.

The lid 950 includes an internal wall 952 that sealingly mates with the internal wall 966 of the housing 960. The internal wall 952 of the lid 950 partitions the lid 950 into separate plenums 954, 956 that independently communicate fluids through apertures 946, 948 with respective processing regions 968, 970 of the housing 960. Membranes 972, 974 respectively bound each plenum 954, 956. The lid 950 additionally includes one or more counter electrodes 958 that may be commonly or independently controlled within each plenum 954, 956. Each plenum 954, 956 also includes a flow port 976 to control the supply of fluids into and/or out of the lid 950.

Alternatively, a lid 990 depicted in the embodiment shown illustrated in FIG. 9C may be utilized with housing similar to the housing 960 described above. The lid 990 generally is similar to the lid 950 except that a single plenum 992 fluidly couples apertures 996, 998 separated by a center wall 994. The center wall 994 is utilized to sealingly interface with the individual process regions 968, 970 of the housing 960. The singular plenum 992 facilitates servicing the process regions 968, 970 of the housing 960 with fluids supplied through a single port 994 similar to the lid 902.

Figure 10:
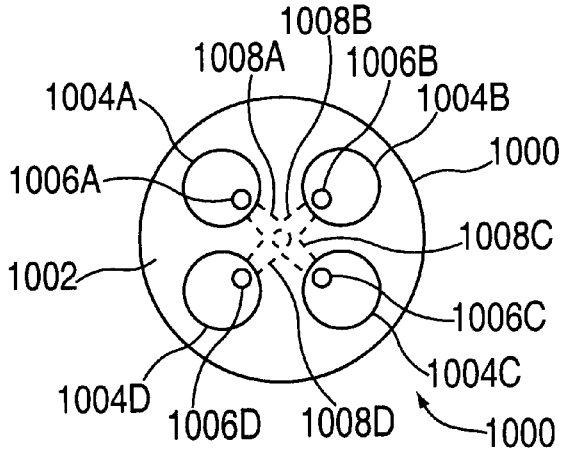
FIG. 10 is a bottom plan view of another embodiment of a lid.
Figure 11:
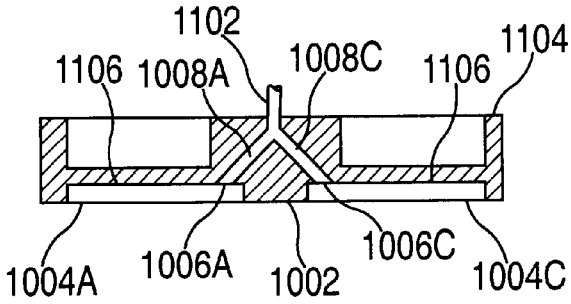
FIG. 11 is a sectional view of the lid of FIG. 10.

FIGS. 10 and 11 depict bottom and sectional views of another embodiment of a lid 1000 configured to sealingly interface with multiple housings (not shown). The lid 1000 generally has a sealing surface 1002 that is adapted to interface with a housing or processing region of each housing in a manner similar to that described above. The sealing surface 1002 has a plurality of process covering regions 1004A–D defined thereon. Each process covering region 1004A–D is adapted to bound a processing region defined within each housing. The interface between the processing region and process covering region 1004A–D is sealingly bounded by the sealing surface 1002. Each process covering region 1004A–D has a respective fluid port 1006A–D disposed therein that fluidly communicates with the processing region of each housing disposed against the lid 1000.

The fluid ports 1006A–D are fluidly coupled by branch channels 1008A–D that merge within the lid 1000 into a central passage 1010. The central passage 1010 exits the lid

1000 at a central port 1102 disposed on a side 1104 of the lid 1000 opposite the sealing surface 1002. The central passage 1010 facilitates supplying fluids through all ports 1006A–D simultaneously to allow rinsing, edge dissolution fluids or other fluids to be disposed through the lid 1000 into the processing regions adjacent the covering regions 1004A–D.

While the foregoing is directed to the preferred embodiment of the present invention, other and further embodiments of the invention may be devised without departing from the basic scope thereof. The scope of the invention is determined by the claims that follow.

What is claimed is:

1. A method of electro-chemical deposition comprising:

flowing an electrolyte into a housing to a level that covers a substrate supported within the housing;

introducing a second fluid below the substrate to displace a portion of the electrolyte from the housing prior to electrically biasing the substrate thereby creating a floating layer of electrolyte surrounding the substrate; and electrically biasing the substrate in the floating layer of electrolyte.

2. The method of claim 1, wherein the second fluid further comprises:

a heavy immiscible liquid.

3. The method of claim 2, wherein the heavy immiscible liquid has a density of at least about 1.2 g/mL and is insoluble in water solutions.

4. The method of claim 2, wherein the displacing step further comprises: recovering electrolyte from the housing.

5. The method of claim 2 further comprising:

removing the electrolyte from the housing after deposition by flowing additional heavy immiscible liquid into the housing.

6. The method of claim 5 further comprising:

draining the heavy immiscible liquid from the housing after the electrolyte is removed.

7. The method of claim 6 further comprising:

flowing water into the housing after at least a portion of the heavy immiscible liquid is drained.

8. The method of claim 5, wherein the heavy immiscible fluid is drained from the bottom of the housing.

9. The method of claim 5, further comprising:

electro-polishing the substrate without removing the substrate from the housing.

10. The method of claim 5 further comprising:

removing deposited material from the edge of the substrate without removing the substrate from the housing.

11. A method of electro-chemical deposition on a substrate, comprising:

sealing the substrate within a housing with a first lid;

flowing an electrolyte into the housing;

applying a bias to the substrate;

removing the first lid and sealing the substrata within the housing with a second lid; and displacing the electrolyte with a heavy immiscible liquid flowing into the housing.

12. A method of electro-chemical deposition on a substrate, comprising supporting a substrate on a substrate support within a housing;

covering the supported substrate with electrolyte;

rotating the drive plate; and electrically biasing the substrate.

13. A method for electrochemically depositing a conductive surface on a substrate, comprising:

supporting the substrate on an upwardly facing substrate support in a housing having an anode above the substrate;

flowing an electrolyte into the housing;

flowing an immiscible liquid having a density greater than the electrolyte into the housing to fill the housing to a level below the upper surface of the substrate support, the total volume of the immiscible liquid and the electrolyte being sufficient that the electrolyte covers the upper surface of the substrate and the lower surface of the anode; and applying an electrical bias to the substrate support and to the anode, whereby a conductive surface is deposited on the upper surface of the substrate.

14. The method of claim 13 further comprising:

removing the electrolyte from the housing after deposition by flowing additional heavy immiscible liquid into the housing.

15. The method of claim 13, including;

electro-polishing the substrate without removing it from the housing.

16. The method of claim 13, including:

removing deposited material from the edge of the substrate without removing the substrate from the housing.

17. A method of electro-chemical deposition comprising:

flowing an electrolyte into a housing having a substrate supported therein;

introducing a heavy immiscible liquid into the housing below the electrolyte to a level sufficient to displace the electrolyte upwardly and create a floating layer of electrolyte surrounding the substrate; and electrically biasing the substrate in the floating layer of electrolyte.

18. The method as defined by claim 17, wherein sufficient heavy immiscible liquid is introduced to displace a portion of the electrolyte from the housing.

* * * * *

UNITED STATES PATENT AND TRADEMARK OFFICE

CERTIFICATE OF CORRECTION

PATENT NO. : 6,685,815 B2
DATED : February 3, 2004
INVENTOR(S) : Kovarsky

It is certified that error appears in the above-identified patent and that said Letters Patent is hereby corrected as shown below:

Column 14,
Line 2, please change “substrata” to -- substrate --.

Signed and Sealed this

Twenty-ninth Day of June, 2004

JON W. DUDAS
*Acting Director of the United States Patent and Trademark Office*